United States Patent [19]

Hopfer

[11] 4,288,761

[45] Sep. 8, 1981

[54] MICROSTRIP COUPLER FOR MICROWAVE SIGNALS

[75] Inventor: Samuel Hopfer, Brooklyn, N.Y.

[73] Assignee: General Microwave Corporation, Farmingdale, N.Y.

[21] Appl. No.: 76,767

[22] Filed: Sep. 18, 1979

[51] Int. Cl.[3] ..... H01P 5/18

[52] U.S. Cl. ..... 333/116; 333/238

[58] Field of Search ..... 333/116

[56] References Cited

PUBLICATIONS

Sachse, *A Wide-Band 3-DB Coupler,* etc., 1973 European Microwave Conference, vol. I, Brussels, Belgium, 4–7, Sep. 1973.

*Primary Examiner*—Paul L. Gensler

*Attorney, Agent, or Firm*—Morton C. Jacobs

[57] ABSTRACT

A microstrip hybrid coupler uses a ground plane having different surfaces, one that is close and coupled to the terminal portions of the microstrip and the others further from and coupled to the coupled microstrip portions. Two shields extend over the coupled microstrip portions; an intermediate shield between the remote ground plane surface and the coupled microstrip portions and an outer shield. The coupled microstrip portions extend over the terminal surface of the ground plane.

5 Claims, 11 Drawing Figures

Fig.4B

1. CHOOSE MICROSTRIP $\epsilon$, h'
2. DETERMINE $Z_{00}$, $Z_{0e}$ FOR GIVEN BW
3. CHOOSE s, b, DETERMINE w ($Z_{00} \simeq Z'_{00}$)
4. CHOOSE $w' = 2w + s + x$ ($x \simeq b$)
5. DETERMINE h FOR $Z_{AB} = \frac{1}{2}(Z_{0e} - Z'_{0e})$[1]
6. COMPENSATE FOR LOADING

1. BAHL AND GARG, PROC IEEE VOL. 65, NOV. 77

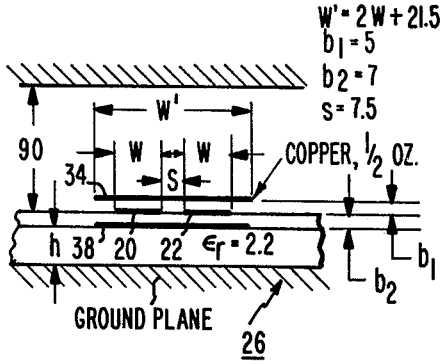

Fig.5A

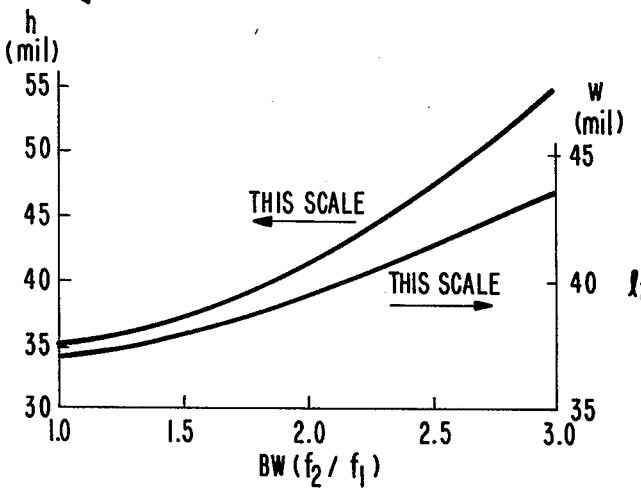

Fig.5B

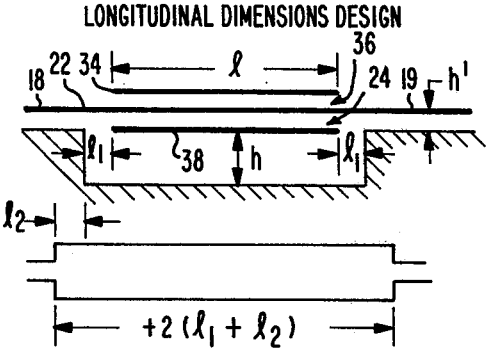

Fig.6A

Fig.6B $$\ell = \frac{\lambda_{om}}{4} \frac{1}{\sqrt{\epsilon_{eff}}}, \quad \epsilon_{eff} = 2.08 \text{ DUROID} \qquad (1)$$

$$\ell_2 = \frac{\ell_1 (Z'_1 - 1/Z'_1) - VC_d Z_0}{Z'_2 - 1/Z'_2}, \quad \ell_1 << \lambda/8 \qquad (2)$$

$$C_d \simeq \frac{2\epsilon W}{\pi} \ln \csc \frac{\pi h'}{2(h+h')} \qquad (3)$$

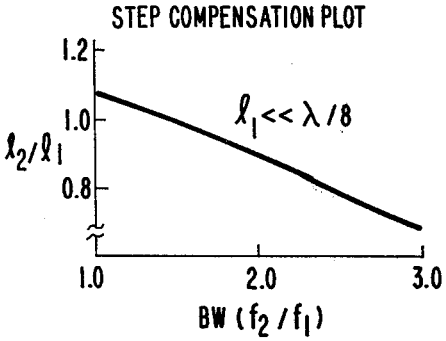

Fig.7

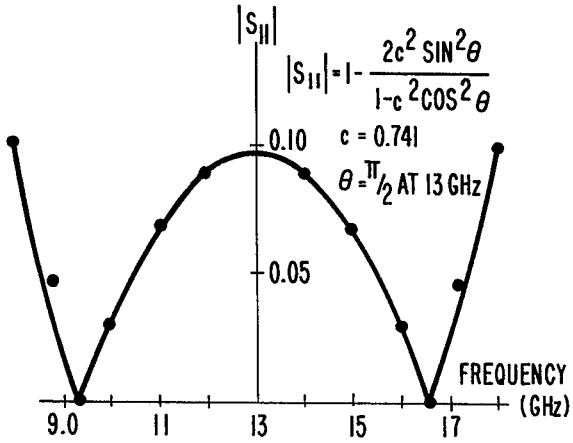

Fig.8

MICROSTRIP COUPLER FOR MICROWAVE SIGNALS

BACKGROUND OF THE INVENTION

This invention relates to microwave coupler devices and particularly to such devices employing microstrip construction.

The microwave coupler known as the hybrid circuit is a four-port device having a certain characteristic impedance at its input and output ports and in which microwave energy supplied at one of its ports is split evenly and produced as output at two of its ports (in a desired in-phase or out-of-phase relation); these two ports are connected to matched load impedances, and no energy is supplied to a matched load at the fourth terminal. Such couplers are components of many more complex devices used widely in microwave systems of various types, especially where a tight or 3-db coupling is achieved. Where such couplers are constructed employing modern microstrip construction in which metallic depositions and etched circuits are used to fabricate extremely small circuit devices, the dimensions and tolerances of the various elements of such couplers become extremely small and close. The difficulty of construction is made that much greater where tight or 3-db coupling is employed.

In designing and fabricating such microstrip couplers for various applications, two overall parameters of concern are that of the overall characteristics impedance of the coupler as seen by a source of microwave energy or a load, to ensure appropriate matching and that of the degree of coupling between the different ports of the coupler device. In determining these parameters, they are generally formulated as functions of two other parameters, namely, the impedances associated respectively with the even-mode and the odd-mode of TEM transmission. The characteristic impedance (input and output) of the coupler is a function of the product of the even-mode and odd-mode impedances. The degree of coupling is a function of the ratio of the even-mode and odd-mode impedances. It is often very difficult to compute these functions and to determine the various dimensions such as the width of the microstrip conductors and the height or spacing between those conductors and the ground plane, as well as the spacing between the conductors themselves. These dimensions may be in terms of mils (thousandths of an inch) or fractions of mils, and correspondingly the tolerances of such small dimensions become extremely tight. It thus becomes extremely difficult both to design and to fabricate such couplers in the modern microstrip technology. Modes of construction of coupler devices dealing with these problems are described in the U.S. Pat. Nos. to Cohn, 3,237,130, Clar, 3,512,110 and Gerst, 3,568,098.

It is among the objects of this invention to provide a new and improved hybrid coupler.

Another object is to provide a new and improved microwave coupler of the microstrip type. Another object is to provide a new and improved microstrip coupler which can be reliably and readily designed. Another object is to provide a new and improved microstrip coupler which can be accurately and reliably fabricated.

SUMMARY OF THE INVENTION

In accordance with one embodiment of this invention, a new and improved microstrip coupler for microwave signals is provided in which the microstrip conductors are fabricated with coupled portions that extend over a certain distance (e.g., a quarter wavelength at the mid-band frequency) in closely spaced relation. These microstrip conductors also have terminal portions that are connected to the four ports of the coupler.

A ground plane has surfaces in different planes; the first (or terminal) surface has a certain dielectric spacing to the terminal portions of the microstrip conductors in order to provide the characteristic terminal impedance of the coupler. A second planar surface of the ground plane has a certain dielectric spacing to the coupled portions of the microstrip conductors which is larger than the terminal spacing. An intermediate electrically conductive coupling member extends between the first face of the coupled microstrip portions and the coupled ground plane portion, and an outer coupling member extends over and is dielectrically spaced from the opposite face of the coupled portions of the microstrip.

With this mode of construction the intermediate coupling shield provides the principal coupling effect of the microstrip conductors. The even-mode impedance is effected primarily by the intermediate shield and its capacitance to the ground plane, rather than by the outer shield which is further away from the ground plane and thereby has a lower capacitance. Thus, the intermediate shield and its parameters are the principal factors in the design of the even-mode impedance. The outer shield and its parameters affect the odd-mode impedance primarily and the even-mode impedance but slightly; to a first order effect, the even-mode impedance is independent of the parameters of the outer shield. The dielectric spacing to the coupled portions of the microstrip conductors only affects the even-mode impedance; the odd-mode impedance is essentially unaffected as though a Faraday shield were surrounding the two coupled portions of the microstrip conductor. Thereby a microstrip coupler is constructed with extremely small dimensions and very close tolerances and economically produced by deposition or etching of the elements of the circuit.

A capacitance between the coupled microstrip portions and the step between the two surfaces of the ground plane is compensated by forming the coupled microstrip portions of greater length than that of the intermediate shield so that they extend over the terminal surface of the ground plane.

BRIEF DESCRIPTION OF THE DRAWINGS

The foregoing and other objects of this invention, the various features thereof, as well as the invention itself, will be more fully understood from the following description, when read together with the accompanying drawings in which:

FIG. 4B is a statement of the steps in cross-section design referenced to the sectional view of FIG. 3 and 4A;

FIG. 5A is a fragmentary idealized transverse sectional view similar to FIG. 4A, and FIG. 5B is an idealized graphical diagram relating elements of the hybrid coupler;

FIG. 6A is a fragmentary idealized longitudinal sectional view similar to FIG. 2, and FIG. 6B is a set of equations relating elements of the hybrid coupler;

FIG. 7 is an idealized graphical diagram relating elements of the hybrid coupler; and FIG. 8 is an idealized graphical diagram relating operating frequency and the input scattering coefficient of the coupler.

Throughout the drawing corresponding parts are similarly referenced.

Figure 1:
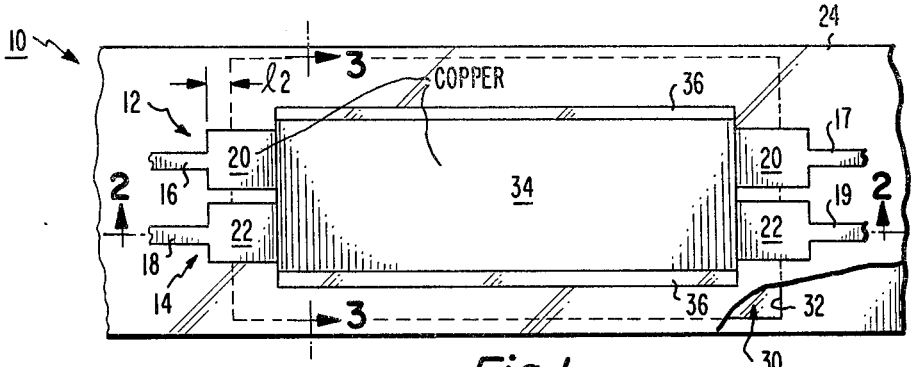
FIG. 1 is an enlarged top view of a microstrip hybrid coupler embodying this invention.
Figure 2:
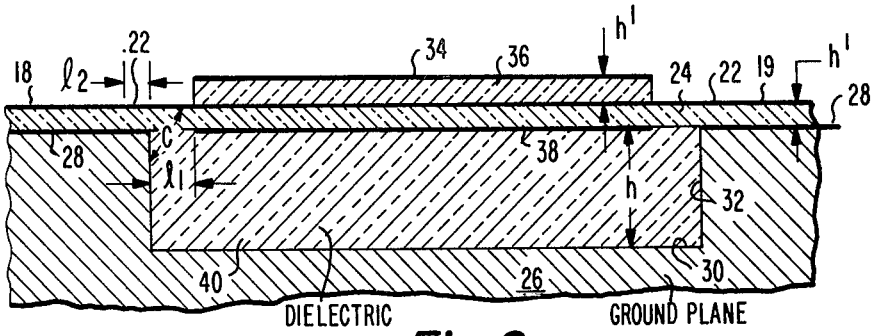
FIG. 2 is a longitudinal sectional view along the line 2—2 of FIG. 1.
Figure 3:
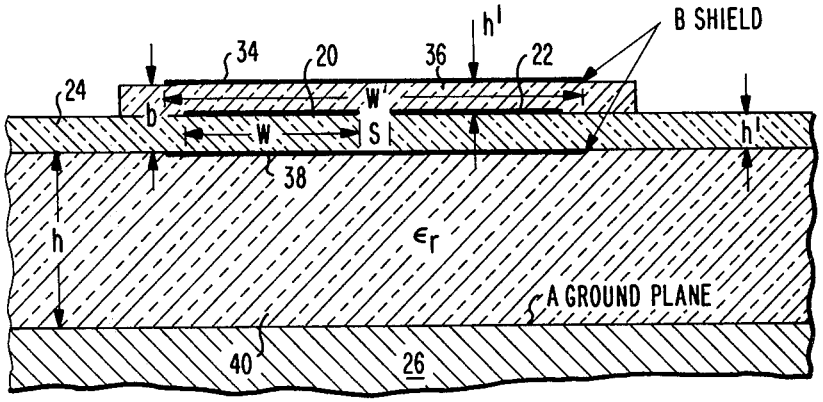
FIG. 3 is a transverse sectional view along the line 3—3 of FIG. 1.

In the embodiment of this invention shown in FIGS. 1–3, a microstrip hybrid coupler 10 includes two microstrip conductor strips 12, 14, respectively formed of terminal portions 16, 17 and 18, 19 and closely coupled portions 20, 22. The microstrips 12, 14 are formed as copper strips on a dielectric substrate and spacer 24, for example, by etching copper-clad Duroid.

The conducting ground plane 26 has surfaces 28, 30 in different planes. A rectangular depression is cut in the larger ground plane surface 28 to form the surface 30 with a step connecting surface 32 between them. The surface 28 principally couples to the microstrip terminal portions 16, 18, and the surface 30 couples to the coupled portions 20, 22.

Extending laterally over the microstrip coupled portions 20, 22 is an outer copper planar coupling shield 34; this may be similarly formed on the dielectric substrate and spacer 36. A second planar intermediate coupling shield 38 is formed, for example, approximately in or near to the plane of ground plane surface 28. This shield 38 may be etched from the underspace of copper-clad Duroid substrate 24, which is initially copper-clad on opposite faces, or by deposition on a suitable substrate. A dielectric spacer 40 of greater thickness is located between shield 38 and ground plane surface 30; i.e., spacer 40 fills the depression that forms ground plane surface 30. The shields 34, 38 have similar lengths and widths and extend laterally beyond the microstrip coupling portions 20, 22 and longitudinally slightly less than the length of ground plane surface 30 by an amount $l_1$. The microstrip coupled portions 20, 22 extend longitudinally beyond the shields 34, 38 and beyond the depression dielectric 40 and over the ground plane surface by an amount $l_2$.

Successive hybrid couplers in a chain may be formed in this fashion. The terminal microstrip portions 17, 19 of one hybrid being connected to the terminals 16, 18 of the next hybrid in the chain, and so on.

In a hybrid coupler there are two sets of impedance relationships. One is the input or output impedance of the overall coupler structure which is used to match to a source or sink of microwave energy. The other is the coupling between the transmission lines carrying that microwave energy. The characteristic impedance of the overall coupler is a function of the product of two impedances, namely, the odd-mode impedance Zoo multiplied by the even-mode impedance Zoe. The coupling between the lines is a function of the ratio of the even-mode to the odd-mode impedance. Thus, in a coupler, once the value of either of these impedances is determined, the other is likewise determined by the choice of terminal impedance and coupling characteristic. As a consequence, it is difficult to design such structures. The coupler design of this invention makes it relatively easy to analyze by separating the two impedances for the odd and even mode of transmission and makes it relatively easy to vary the parameters and arrive at the desired set of parameters for a particular design.

In this invention, the structures are such that the outer shield 34 serves principally to vary the odd-mode impedance, while affecting the even-mode impedance relatively slightly. For example, by changing the spacing h' (spacer 36) of the outer shield 34 from the coupled conductors 20, 22 from about ten mils to seven mils, the odd-mode impedance might be changed by some 6% to 8%, while the even-mode impedance by only a 2% effect.

The height h of the depression dielectric 40 affects the even-mode impedance substantially, but the odd-mode impedance is affected only negligibly, as though a Faraday shield were formed around the coupled strips 20, 22 so that the latter were isolated from the ground plane. The even-mode impedance is affected primarily by the capacitance of the intermediate shield 38 to ground surface 30 and relatively a minor amount by the capacitance of the outer shield 34 to ground surface 30 (the latter capacitance being very much less). One reason for this is that the outer shield 34 is much further away. The intermediate shield 38 couples the strips 20, 22 and, with respect to the even-mode impedance, brings them into proper relationship with the ground plane surface 30 formed within the depression 30.

The hybrid coupler as a four-port device may have the first port 16 connected to a source of microwave energy externally and presents a terminal impedance to that source (such as the commonly used characteristic impedance of 50 ohms) for proper matching. The second port 17 is directly connected to the first port via the microstrip 20 and provides one output while the fourth output 18 which is in a coupled or induced relationship to the first port provides a second output. There is an even split of the power supplied to the outputs; half of the energy is supplied to the second port 17 and half to the fourth port 18, with the fourth port output having a 90° rotation or phase-change with respect to the first port. The third port 19 is terminated and ideally has zero output and is called the isolated port. One other feature of the hybrid coupler is that the coupling is close on the order of 3 db.

Since the two shields 34, 38, outer and intermediate, effectively isolate the microstrips, the location of the ground plane, i.e., the height of the dielectric 40, has a negligible effect on the odd-mode impedance. That is, in the odd mode, the field lines extend between the microstrips 20, 22 and between those strips and the two shields 34, 38, and since the shields extend preferably beyond the ends of the microstrips, there is a negligible stray field that escapes from the two open ends. Thus, the spacing or height of a dielectric 24, 36 from the strips 20, 22 to each of these shields 34, 38 has a material effect on the odd-mode impedance as well as the even-mode impedance. The spacing of the outer shield 34 is primarily affecting the odd-mode impedance while the spacing of the intermediate shield 38 is primarily affecting the even-mode impedance. In the odd mode, the lines of force are primarily between the strips and the shields, and the ground plane and the shields 34, 38 are essentially the same potential. The capacitances from each microstrip 20, 22 to each shield 34, 38 are essentially in series. Thus, the capacitance between the microstrips is one-half the sum of the capacitances to the outer and intermediate shields 34, 38. Therefore, an increase in the outer shield spacing produces a relatively substantial change in the capacitance between the microstrips.

In the even mode, the lines of force extend between the coupled microstrips and the shields and between the shields and the common ground plane 30 for the coupled region. If now there is an increase in the distance of the outer shield 34 from the microstrips 20, 22, the charge on the outer shield is decreased while the charge on the intermediate shield is incresed, by not as much as the decrease in charge on the outer shield. Thus, the capacitance of the microstrips to ground 30 changes very little with the increase of spacing of the outer shield, e.g., an increase due to the increase in capacitance to the outer shield, while the capacitance to the intermediate shield is unchanged. The microstrip capacitance to ground is the combined capacitances to the outer and intermediate shields in parallel. Thus, to achieve a tighter coupling, one brings the outer shield closer to decrease the odd-mode impedance, and therefore, increase the ratio of the even-mode to the odd-mode impedance. At the same time, the even-mode impedance may be affected but proportionately not as much. At the same time, there may be a change in the characteristic input impedance by the square root of the change in the odd-mode impedance, but this is relatively small. Initially, one chooses the thickness of the intermediate shield dielectric 24 based upon the characteristic terminal impedance that is desired and the frequency and other parameters of the overall unit. Once selected, the even-mode impedance is then achieved primarily by the height of the dielectric 40 and the odd-mode impedance by the height of the outer shield dielectric 36.

Figure 4A:
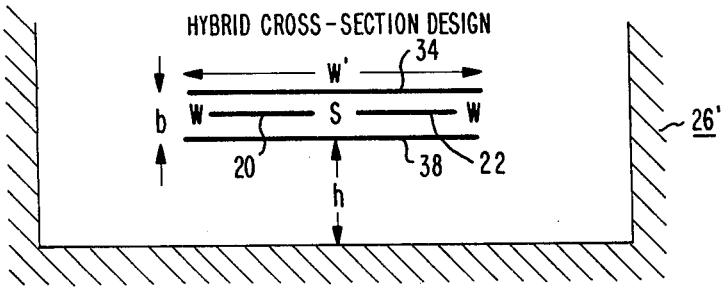
FIG. 4A is an idealized transverse sectional view similar to FIG. 3 showing relationships of parts.

Generally, both shields are chosen to have the same width and they exceed the combined widths of the coupled strips 20, 22 by the amount indicated in FIG. 4A. By making the shields wider, only the even-mode impedance essentially would be affected; it would be lowered since in the ratio of width to height, the width would be increased and therefore the capacitance to ground would be increased.

In this coupler structure, one form includes a dielectric wafer having a copper coating on each side; for example, five-mil (or seven-mil) Duroid. This is a Teflon material impregnated with glass fibers and it has a dielectric constant of about 2.2. With this material the copper on one side becomes the shield 38 and the copper on the other side is etched away to form the desired pattern of microstrip circuitry. For the outer shield 34, the same kind of material is used, except that the copper on one side is completely etched away, leaving only one side with copper which forms the outer shield.

In a modified configuration, the microstrips 20, 22 may be twisted within the coupled region to form the second and fourth ports on the same side. That is, in the quarter wavelength region there are two parallel sections of one-eighth wavelength, with a connection from one side to the other side being formed and etched in the copper. A thin layer of dielectric is placed over that cross-over portion and a thin ribbon is then set down to connect the other two half strips. There is a very small capacitance between the cross-over region so that effectively the coupling is continued.

With this invention, a metallic ground plane unit is formed with a plurality of holes milled or hammered into it of precise depth. Thereafter, each one of these holes is plugged with dielectric 40 to the terminal ground plane level. Thereupon, the Duroid sheet 24 is laid down with the shield 38 cemented to the plug and the topology of the microstrip circuitry formed in the upper layer. Then, by means of an epoxy layer the top Duroid sheet 36 and shield 34 is applied.

In designing the cross-section features of this hybrid coupler, the first five steps outlined in FIG. 4B are followed. Analyzing the coupled structure in terms of the odd and even-mode impedances Zoo and Zoe, respectively, the former should approximately be given by $$Zoo \simeq Z'oo$$

where Z'oo is the odd-mode impedance of the structure inside the floating shields 34, 38, but with infinite ground planes in place of the shields of finite width W'. Similarly, the even-mode impedance is approximately given by $$Zoe \simeq Z'oe + 2Z_{AB}$$

where Z'oe is the even-mode impedance of the same structure as defined above for Z'oo, and where $Z_{AB}$ is the impedance of an equivalent two-conductor microstrip configuration of strip width W', thickness b, and elevation h. The above equations, in conjunction with the analytic information available in the literature for Z'oo, Z'oe and $Z_{AB}$ as well as the standard relationships of coupled structures suffice in order to follow the procedure of FIG. 4B and to determine the cross-sectional dimensions. In addition, the sandwich formed of the shields 34, 38 is treated as one thick plate inside the ground plane 26' to minimize the latter's effects for simplification purposes. In this way, the first five design steps are carried out. Thereafter, the sixth step of compensating for loading is performed in which the capacitive effect of the ground plane surface 28 is taken into account. That is, the outer shield 34 increases the capacitance between sandwich and ground, which decreases the impedance of the sandwich and thereby of the even-mode impedance. But the odd-mode impedance is unaffected, so that the ratio of the even- to odd-mode impedance decreases, which results in a decrease in the microstrip coupling.

This effect is compensated by making thinner the dielectric spacer 36 to bring the outer shield 34 closer, increase the capacitive coupling and thereby decrease the odd-mode impedance also. In this fashion, the dielectric spacer 36 is made thinner than the spacer 24, as indicated in the parameter sketch in the diagram of FIG. 5A. That is, dielectric spacer 36 ($b_1$) is made 5 mils, while spacer 24 ($b_2$) is 7 mils. Also, the spacer 36 may be made larger than the spacer 24 for an optimal design. Thus, this feature of the invention of different thicknesses of spacers 24 and 36 can be readily achieved without materially affecting the remainder of the design. FIG. 5B also relates the w and h design to the bandwidth (BW).

The longitudinal dimensions are affected by the step discontinuity in the ground plane which should be compensated for. This compensation is achieved by extending the coupled strips of width W beyond the shielded region for a length $l_1 + l_2$ as shown in FIG. 6A. In terms of $l_1$, which may be somewhat arbitrary and, in our case, chosen to be equal to b, $l_2$ is approximately given by equation-2 of FIG. 6B, where $Z'_1$ and $Z'_2$ refer to ratios of the different $Z_o$'s appearing in the transition region, v is the phase velocity in the $l_2$ region, and $C_d$ is the fringing capacity indicated in FIG. 2 and approximately given by equation-3 of FIG. 6B. The shield length is given by equation-1. While the above equations define relative dimensions of the coupled structure, the absolute dimensions are subject to some choice. In practice, it is convenient to choose initially the dielectric constant $\epsilon_r$ of the material, the thickness h' of the microstrip transmission line, the separation S of the coupled lines and, to some extent, the width W' of the shields. A typical set of parameters used in most of our applications is as follows:

Material: Duroid, $\epsilon_r=2.18$ $h'=0.007''$ $S/b=0.5$ $W'=2W+s+b$

The portions of the microstrips 20 and 22 that extend beyond the shields 34 and 38 are essentially uncoupled. The impedances of those unshielded strips are therefore based on the spacing to the ground plane. See, for example, the capacitive fringing effect C shown in FIG. 2 to the step surface 32 of the ground plane. Due to this greater spacing, the capacitance is less, and the impedance tends to be greater than the characteristic impedance (e.g., of a 50 ohm line). This impedance increase over length $l_1$ is like adding a small series inductance to the line. The fringing effect of the connecting ground plane surface 32 tends to present a small shunt capacitance. The $l_2$ overlap with ground plane surface 28 of the extended strips 20 and 22 is a decrease in impedance, like a small shunt capacitance. These shunt capacitances and series inductance act like an all-pass filter to eliminate largely the effects of these discontinuities and produce an optimal design. FIG. 7 is a plot of the step compensation design relating the ratio of $l_2/l_1$ to bandwidth, based on a choice of $l_1$ small compared to an eighth wavelength. In practice, $l_1$ is of the order of the dimension b (FIG. 3), the overall sandwich thickness; e.g., about 20 mils or less. The construction of hybrid couplers as parts of microwave integrated circuits is achieved by fitting dielectric slabs into rectangular depressions in the metallic ground plane. The dielectric substrate, containing rf circuitry on the top and shields 38 on the bottom, is then placed over the ground plane. Finally, the outer shields 34 are put in place. With all parts referenced to a common set of alignment pins, the assembly becomes routine and is reproducible within close tolerances.

Since the major application of the microstrip hybrid coupler is that of a component in an integrated circuit assembly, it is highly desirable to infer its performance from data obtained with the coupler in situ. A critical parameter of the design is the midband coupling coefficient C. Its criticalness becomes evident when the direct and coupled arms of the hybrid are terminated in identical but totally reflecting impedances and the fourth port is properly terminated. Under these conditions, the magnitude of the input scattering coefficient $S_{81}$ can be shown to be given by $$|S_{||}|=1-(2C^2\sin^2\theta/1-C^2\mathrm{Cos}^2\theta)$$

A plot of this equation is shown in FIG. 8 for the 8–18 GHz band, indicating the nulls of the reverse spectrum at 9.4 and 16.6 GHz, respectively, which correspond to the 3-db coupling points. Since the magnitude of $S_{||}$ changes very rapidly in the vicinity of the null and the reflection experiences a phase reversal, the superposition of such a reflection on other, usually smaller, reflections is easily recognizable. Thereby, the hybrid can be determined to be properly coupled, or not; and, if not, the direction of correction is indicated to minimize the deviation from 3-db for the chosen bandwidth.

This invention is described in applicant's paper published in the IEEE MTT-*S*, 1979, International Microwave Symposium Digest, pp. 428–430, which is here incorporated by reference.

Thus, a new and improved microstrip hybrid coupler is provided by this invention. As a basic microwave circuit element, it has numerous applications; see, for example, applicant's copending patent application Ser. No. 076,768 filed concurrently herewith for an "Analog Phase Shifter".

What is claimed is:

1. A microstrip coupler for microwave signals having a certain terminal impedance comprising:

a plurality of coplanar thin microstrip conductors having terminal portions, coupled portions extending over a certain distance with their edges in closely spaced parallel relation, and connecting portions between said terminal and coupled portions, said coupled and connecting portions being substantially wider than said terminal portions;

conductive means providing an electrical ground plane having different ground plane surfaces in different planes including a first planar surface having a certain dielectric spacing to said terminal microstrip portions in accordance with the characteristic terminal impedance of said coupler, a second planar surface having a certain dielectric spacing to said coupled microstrip portions larger than said terminal spacing, and a connecting surface between said planar surfaces;

a first thin electrically conductive coupling member between one face of said coupled microstrip portions and said second ground plane surface and of a length less than the length of said second ground plane surface;

and a second thin electrically conductive coupling member extending over and dielectrically spaced from the opposite face of said coupled microstrip portions;

said connecting microstrip portions of said microstrip conductors extending in length between said first coupling member and at least said connecting ground plane surface to compensate for capacitive coupling between said connecting microstrip portions and said connecting ground plane surface.

2. A microstrip coupler as recited in claim 1, wherein said second ground plane surface is formed as a depression in said conductive means.

3. A microstrip coupler as recited in claim 1 wherein said connecting microstrip portions extend in length over said first ground plane surface.

4. A microstrip coupler for microwave signals having a certain terminal impedance comprising:

a plurality of coplanar microstrip conductors having terminal portions, coupled portions extending over a certain distance in closely spaced parallel relation, and connecting portions between said terminal and coupled portions; said coupled and connecting portions being substantially wider than said terminal portions;

conductive means providing an electrical ground plane including one planar portion having a certain dielectric spacing to said terminal microstrip portions in accordance with the characteristic terminal impedance of said coupler, and another planar portion having a certain dielectric spacing to said coupled microstrip portions larger than said terminal spacing, and a connecting surface between said planar portions;

a first electrically conductive coupling member between one face of said coupled microstrip portions and said another planar portion;

a second electrically conductive coupling member extending over and dielectrically spaced from the opposite face of said coupled microstrip portions;

said connecting portions of said microstrip conductors in the region between said coupled portions and said connecting ground plane surface having a width substantially equal to said coupled microstrip portions and compensating for discontinuity in the microstrip impedance.

5. A microstrip coupler as recited in claim 4 wherein said connecting portions of said microstrip conductors include a length thereof extending over said one planar portion of said ground plane.

* * * * *